US006793459B2

(12) United States Patent
Chujo et al.

(10) Patent No.: US 6,793,459 B2
(45) Date of Patent: Sep. 21, 2004

(54) WATER PUMP

(75) Inventors: Masaki Chujo, Chiryu (JP); Yoshiaki Nakano, Toyohashi (JP); Atsushi Chiba, Toyoake (JP); Shuhei Yamazaki, Chita-gun (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 20 days.

(21) Appl. No.: 10/385,613

(22) Filed: Mar. 12, 2003

(65) Prior Publication Data

US 2003/0175118 A1 Sep. 18, 2003

(30) Foreign Application Priority Data

Mar. 15, 2002 (JP) ..... 2002-071987

(51) Int. Cl.[7] ..... F01D 25/26
(52) U.S. Cl. ..... 415/213.1; 415/214.1
(58) Field of Search ..... 415/213.1, 214.1, 415/229

(56) References Cited

U.S. PATENT DOCUMENTS 3,871,790 A * 3/1975 Rameau ..... 415/214.1
4,925,367 A * 5/1990 Paliwoda et al. ..... 415/213.1
5,275,538 A * 1/1994 Paliwoda et al. ..... 417/314
5,482,432 A * 1/1996 Paliwoda et al. ..... 415/168.2
6,120,243 A * 9/2000 Tanabe ..... 415/112

FOREIGN PATENT DOCUMENTS

JP 10-266857 3/1997

* cited by examiner

*Primary Examiner*—Hoang Nguyen
(74) *Attorney, Agent, or Firm*—Reed Smith LLP; Stanley P. Fisher, Esq.; Juan Carlos A. Marquez, Esq.

(57) ABSTRACT

A water pump includes a body, a fixing member to which the body is fixed hermetically via a gasket, and an impeller which is fixed to an end part of a shaft supported rotatably by the body and housed in a vortex chamber formed in the body or in the fixing member. Further, the impeller has a circular plate into which the end part of the shaft is inserted and a plurality of blades radially provided on the circular plate at one side facing the fixing member or the other side facing the body and project from the circular plate to the fixing member side or the body side.

In the water pump, the gasket has an intermediate plate with high rigidity and metal gaskets disposed between the intermediate plate and the body, and between the intermediate plate and the fixing member for sealing. The intermediate plate extends in radial direction to keep a predetermined axial distance between an inner peripheral portion of the intermediate plate and an end part of the blades facing to the fixing member or to the body.

3 Claims, 3 Drawing Sheets

WATER PUMP

CROSS REFERENCE TO RELATED APPLICATIONS

The application is based on and claims priority under 35 U.S.C. §119 with respect to a Japanese Patent Application 2002-071987, filed on Mar. 15, 2002, the entire content of which is incorporated herein by reference.

FIELD OF THE INVENTION

This invention generally relates to a water pump and more particularly, this invention pertains to a water pump which compulsorily circulates cooling water of an engine for automobile.

BACKGROUND OF THE INVENTION

A conventional water pump is disclosed in for example, a Japanese Patent Application Publication published as Toku-Kai-Hei 10(1998)-266857. This water pump includes a body, a fixing member to which the body is fixed hermetically via a metal gasket, and an impeller. The impeller is supported rotatably by the body and housed in a vortex chamber formed in the fixing member. Further, the impeller has a circular plate with which the impeller is inserted and blades which extend radially on the body side of the circular plate and project from the circular plate. The metal gasket extends so as to keep a predetermined axial distance between an end part of the body side of the blade and an inner peripheral portion of the metal gasket.

In this conventional water pump, the metal gasket functions so that the gasket separates an intake passage (low pressure side) from a delivery passage (high pressure side) and the axial distance between the blades of the impeller and the metal gasket is kept to maintain a stable delivery performance of the water pump.

Accordingly, high rigidity is needed to be durable against a large pressure difference between the intake passage and the delivery passage.

Meanwhile, flexibility is also needed to form a bead or a folded rib etc. on the metal gasket for ensuring sealing function and improving surface pressure, so the metal gasket needs to be formed of a thin metal plate etc.

However, the metal gasket formed of the thin metal plate has difficulty in compatibility between the sealing function and the high rigidity. And the metal gasket formed of many layers of the thin metal gasket has possibility that deformation and peeling may occur by the pressure difference between the intake passage and the delivery passage.

Now therefore, a technical object of this present invention is providing the water pump ensuring the sealing function as well as the dividing function.

SUMMARY OF THE INVENTION

According to an aspect of the present invention, a water pump includes a body, a fixing member to which the body is fixed hermetically via a gasket, and an impeller which is fixed to an end part of a shaft supported rotatably by the body and housed in a vortex chamber formed in the body or in the fixing member. Further, the impeller has a circular plate into which the end part of the shaft is inserted and a plurality of blades radially provided on the circular plate at one side facing the fixing member or the other side facing the body and project from the circular plate to the fixing member side or the body side.

In the foregoing water pump, the gasket has an intermediate plate with high rigidity and metal gaskets disposed between the intermediate plate and the body, and between the intermediate plate and the fixing member for sealing. The intermediate plate extends in radial direction to keep a predetermined axial distance between an inner peripheral portion of the intermediate plate and an end part of the blades facing to the fixing member or to the body.

According to another aspect of the present invention, the gasket includes a primary bore and a secondary bore. The primary bore is formed opposite to the blades of the impeller with a predetermined axial distance between an inner peripheral portion of the primary bore and the end part of the blades facing to the fixing member or to the body. And the secondary bore communicates with an intake passage or a delivery passage. Consequently, a flow passage is formed between a part dividing the primary bore from the secondary bore and the body or the fixing member.

BRIEF DESCRIPTION OF THE DRAWING FIGURES

The foregoing and additional features and characteristics of the present invention will become more apparent from the following detailed description considered with reference to the accompanying drawing figures wherein.

DETAILED DESCRIPTION OF THE INVENTION

Figure 1:
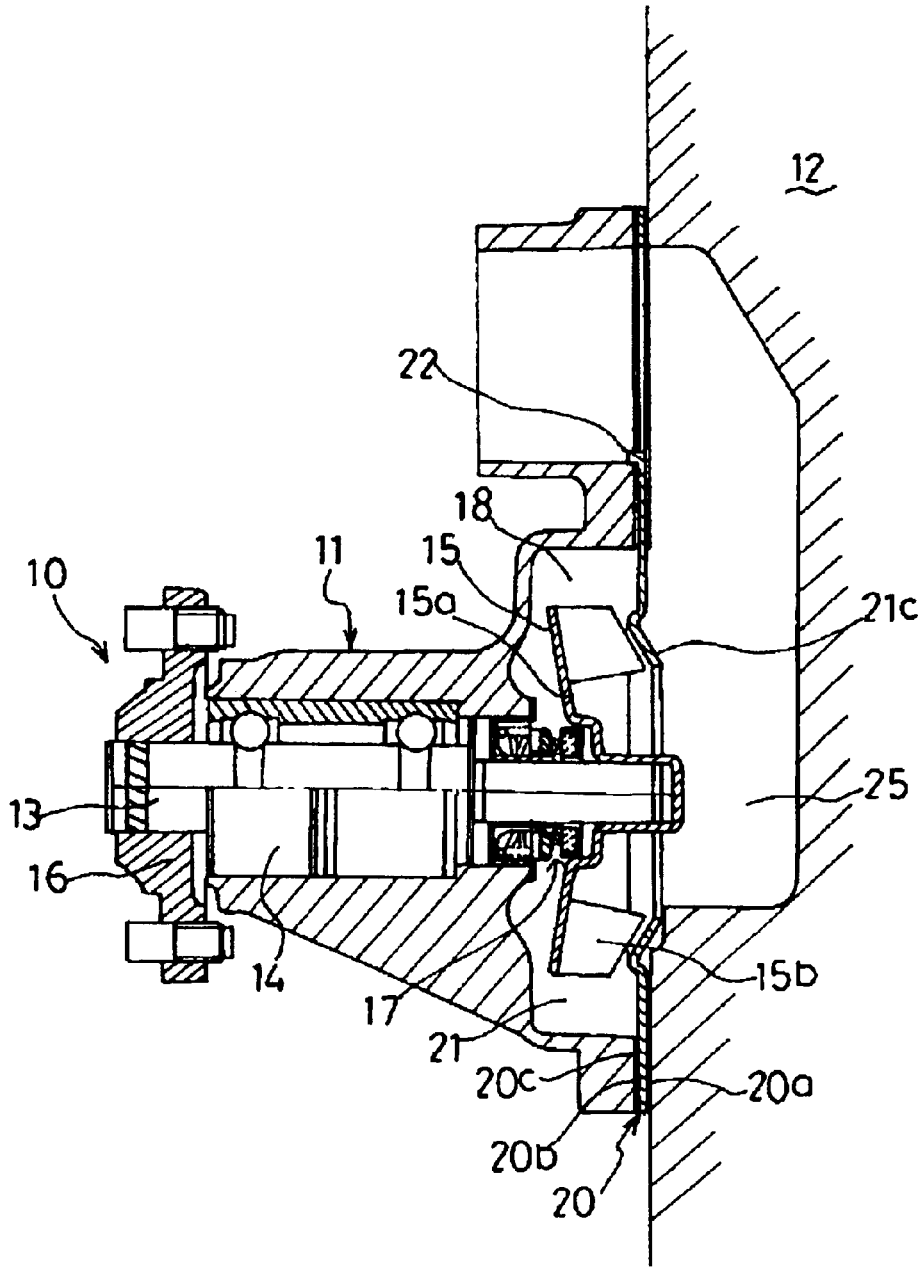
FIG. 1 is a cross sectional view of a water pump according to an embodiment of present invention.

With reference to FIG. 1, a water pump 10 according to an embodiment of the present invention is applicable to a water pump for a V-type engine. As shown in FIG. 1, a body 11 of the water pump 10 has a cylindrical bore and a vortex chamber 18 (a fluid chamber) which is open to a cylinder block 12 (a fixing member). A shaft 13 is supported rotatably within the bore via a bearing 14 and an impeller 15 is supported on one end part of the shaft 13. The impeller 15 has a circular plate 15*a* and blades 15*b* which extend radially from the circular plate 15*a* to a side of the cylindrical block 12 and project from the circular plate 15*a*. The impeller delivers cooling water near the center of the vortex chamber 18 toward an outer peripheral portion of the impeller by rotation in the vortex chamber 18. Mechanical seal 17 is provided between the bearing 14 and the Impeller 15 and with which the vortex chamber 18 is hermetically sealed. Meanwhile, the other end part of the shaft 13 is inserted in a pulley seat 16 which is connected a pulley (not shown) which is connected to a power source (not shown), for example a crank pulley of the engine via belt. A timing belt case and so on can be also applied as the fixing member.

Figure 3:
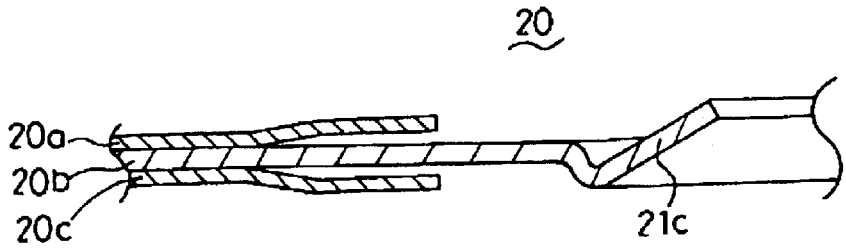
FIG. 3 is a cross sectional view taken along the line A—A in FIG. 2.

The body 11 of the water pump 10 is fixed to the cylindrical block 12 via a gasket 20 (a sealing means). As shown in FIG. 3, the gasket 20 includes an intermediate plate 20*b* and metal gaskets 20*a*, 20*c*. The intermediate plate 20*b* has a high rigidity by thickening the plate or using a high rigidity material. The intermediate plate 20*b* is hermetically sealed to the cylindrical block 12 and the body 11 by the metal gaskets 20*a* and 20*c* respectively. For example, a metal plate of which both sides are coated with non-metallic material such as rubber or synthetic resin etc. is used as the metal gasket, a coating method or a film thickness is not particularly limited. The intermediate plate 20*b* has a primary bore 21*a*, a secondary bore 21*b* and an intake bore 21*d*. An inner peripheral portion 21*c* of the primary bore 21*a* is located opposite to the blades 15*b* so as to keep a predetermined axial distance. The secondary bore 21*b* communicates with two delivery passages (not shown) formed on the right and the left side of the cylindrical block 12, and the intake bore 21*d* communicates with an intake passage (not shown) formed on the body 11. Furthermore, a part which divides the primary bore 21*a* from the secondary bore 21*b* on the intermediate plate 20*b* forms a delivery passage 21 between the body 11 and the part and an intake passage 25 communicating with the intake bore 21*d* between the cylindrical block 12 and the part.

Next, operation of the embodiment of present invention relating to the water pump is described below.

The shaft 13 connected to the pulley seat 16 rotates by a torque being transmitted from an engine via the pulley which is connected to the pulley seat 16. Consequently, the impeller 15 connected to the shaft 13 rotates together within the vortex chamber 18 which is hermetically sealed by the gasket 20 and formed on the body 11.

When the vortex chamber 18 is filled with cooling water, cooling water near the center of the vortex chamber 18 is sucked in and radially delivered toward an outer peripheral portion of the impeller 15 by rotation of the impeller 15. Consequently, a pressure around the center of the impeller 15 becomes less than a pressure of a surrounding part in the vortex chamber 18, and the intermediate plate 20*b* receives force toward a side of the body 11 near the center of the vortex chamber 18. Meanwhile, the cooling water is sucked in through the intake passage 25 and delivered to the delivery passage 21. Accordingly, the pressure in the intake passage 25 which communicates with the intake bore 21*d* from the primary bore 21*a* becomes low, and the pressure in the delivery passage 21 which communicates with the secondary bore 21*b* from the outer peripheral portion of the impeller 15 becomes high. The intermediate plate 20*b* is placed between the intake passage 25 and the delivery passage 21 so as to divide the intake passage 25 from the delivery passage 21 formed respectively. Consequently, the intermediate plate 20*b* receives force toward the intake passage 25 or a side of the cylindrical block 12 in a part which divides the intake passage 25 from the delivery passage 21 by the intermediate plate 20*b*. The intermediate plate 20*b* has the high rigidity by thickening the plate or using the high rigidity material. Accordingly, such deformation can be prevented. Consequently, the predetermined axial distance between the inner peripheral portion 21*c* of the intermediate plate 20*b* and the blades 15*b* is kept in near the center of the vortex chamber 18. Furthermore, in the part which divides the intake passage 25 from the delivery passage 21 by the intermediate plate 20*b*, the intake passage 25 and the delivery passage 21 are maintained, so delivery performance of the water pump is kept stable.

Additionally, a folded rib 22 or a bead to achieve the high rigidity may be provided on the intermediate plate 20*b* of the gasket 20 to improve a dividing function. And any reinforcement means may be provided on the intermediate plate as long as such shape does not prevent a water flow and control a water flow. Correspondingly, as shown in FIG. 3, forming a conical shape on the inner peripheral portion 21*c* of the intermediate plate 20*b* which is used to be formed on the engine block or timing chain case by casting or machining also may be applied. Consequently, the intermediate plate 20*b* of the gasket 20 can be formed inexpensively by machining and press molding. Thus a drastic reduction of cost can be achieved.

Figure 2:
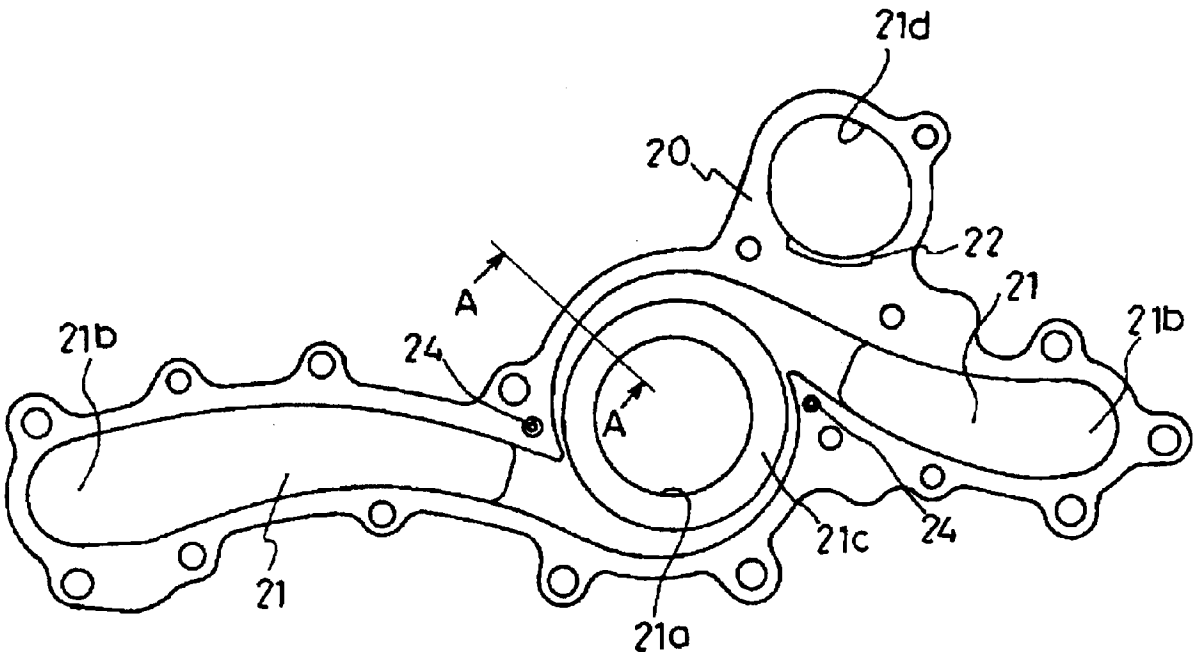
FIG. 2 is a front view of a gasket illustrated in FIG. 1.

Furthermore, for example, as shown in FIG. 2, the intermediate plate 20*b* may be connected to the metal gasket 20*a* and 20*c* via rivet staking 24 or press staking etc. on the low pressure side of the intake passage 25 near the vortex chamber 18, the high pressure side of the delivery passage 21 and a part where the pressure difference is large near the vortex chamber 18 so as to prevent deformation or peeling of the metal gasket 20*a* and 20*c* of the gasket 20. Consequently, sealing performance is maintained as well as the high rigidity.

According to an aspect of this present invention which relates to the water pump, the dividing function of the gasket can be maintained, and the deformation or the peeling by the pressure difference between the low pressure of the intake part and the high pressure of the delivery part can be prevented on the part which divides the intake part from the delivery part by the intermediate plate. Additionally, a sealing function of the gasket can be maintained by the metal gasket which is provided and seals respectively between the intermediate plate and the body or the fixing member. Consequently, the dividing function can be compatible with the sealing function.

And the gasket can form the passage which communicates with the delivery passage (not shown) or the intake passage (not shown) between the part which divides the primary bore from the secondary bore and the body or the fixing member.

The principles, preferred embodiments and mode of operation of the present invention have been described in the foregoing specification. However, the invention which is intended to be protected is not to be construed as limited to the particular embodiments disclosed. Further, the embodiments described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What we claim is:

1. A water pump, comprising:

a body;

a fixing member to which the body is fixed hermetically via a sealing means; and an impeller which is fixed to an end part of a shaft supported rotatably by the body and housed in a fluid chamber formed in the body or in the fixing member, the impeller having a circular plate into which the end part of the shaft is inserted, and a plurality of blades radially provided on the circular plate at one side facing the fixing member or the other side facing the body, and projecting from the circular plate to the fixing member side or the body side, wherein the sealing means has an intermediate plate with high rigidity and metal gaskets disposed between the intermediate plate and the body, and between the intermediate plate and the fixing member for sealing, the intermediate plate extending in radial direction to keep a predetermined axial distance between an inner peripheral portion of the intermediate plate and an end part of the blades facing to the fixing member or to the body.

2. A water pump, according to claim 1, wherein the sealing means includes a primary bore formed opposite to the blades of the impeller with a predetermined axial distance between an inner peripheral portion of the primary bore and the end part of the blades facing to the fixing member or to the body, and a secondary bore communicating with an intake passage or a delivery passage, and wherein a flow passage is formed between a part dividing the primary bore from the secondary bore and the body or the fixing member.

3. A water pump, comprising:

a body;

a fixing member to which the body is fixed hermetically via a sealing means; and an impeller which is fixed to an end part of a shaft supported rotatably by the body and housed in a fluid chamber formed in the body, the impeller having a circular plate into which the end part of the shaft is inserted, and a plurality of blades radially provided on the circular plate at a side facing the fixing member, and projecting from the circular plate to the fixing member side, wherein the sealing means has an intermediate plate with high rigidity and metal gaskets disposed between the intermediate plate and the body, and between the intermediate plate and the fixing member for sealing, the intermediate plate extending in radial direction to keep a predetermined axial distance between an inner peripheral portion of the intermediate plate and an end part of the blades facing to the fixing member.

* * * * *